United States Patent [19]

Loucks, Sr.

[11] 4,000,800

[45] Jan. 4, 1977

[54] ELECTROMECHANICAL INTERLOCK DEVICE FOR A VENDING MACHINE

[75] Inventor: Wesley T. Loucks, Sr., Cincinnati, Ohio

[73] Assignee: William F. Shepherd, Inc., Cincinnati, Ohio

[22] Filed: Oct. 9, 1975

[21] Appl. No.: 621,218

[52] U.S. Cl. ..... 194/9 R; 194/DIG. 3; 221/129; 221/152; 221/153; 221/125

[51] Int. Cl.[2] ..... G07F 5/10

[58] Field of Search ..... 221/152, 153, 125, 129; 194/1 L, DIG. 3, 1 C, 9 R

[56] References Cited

UNITED STATES PATENTS

| | | | |
|---|---|---|---|
| 2,272,859 | 2/1942 | Wilsey | 221/129 X |
| 2,438,502 | 3/1948 | Holt | 221/129 X |
| 3,294,286 | 12/1966 | Zibbell | 221/129 X |
| 3,929,257 | 12/1975 | Mohan | 221/152 |

*Primary Examiner*—Allen N. Knowles
*Attorney, Agent, or Firm*—Wood, Herron & Evans

[57] ABSTRACT

An electromechanical interlock device is interposed between an electrical credit system and a mechanical product dispenser. In preferred form, the interlock device includes a solenoid electrically connected to the credit system, and a drive cam adapted to be positively rotated by the manually operated mechanical product dispenser. The interlock device also includes a locking arm spring loaded into locking engagement with the drive cam to prevent unauthorized rotation thereof, an activator arm connected to the solenoid and adapted to remove the locking arm from locking engagement with the drive cam, and a latch lever. The solenoid is electrically energized upon deposit of the coinage required to achieve vending of a product, the solenoid driving the activator arm and, hence, the locking arm, into the unlock position, thereby withdrawing the locking arm from interlock engagement with the drive cam. As the locking arm's unlock position is achieved, the latch lever, which is tension spring connected with the locking arm, latches the activator arm in the unlock attitude, thereby also latching the lock arm in the unlock position. Subsequently, the drive cam is rotated by the manually operated mechanical product dispenser as that dispenser is operated by the customer to vend a product. The drive cam contacts the latch lever during the drive cam's rotational movement to remove the latch lever from latched engagement with the activator arm. Such permits the spring loaded locking arm to reset into locking relation with the drive cam once the product dispenser's vend cycle has been completed.

6 Claims, 5 Drawing Figures

ELECTROMECHANICAL INTERLOCK DEVICE FOR A VENDING MACHINE

This invention relates to vending machines and, more particularly, relates to an electromechanical interlock device interposed in a vending machine environment between an electrical coin changer and a mechanical product dispenser.

The vending machine industry has undergone a great period of growth over the years in terms of dollar volume, as well as in terms of different types of products sold. Historically, vending machines were initially designed to vend candy-type products for 1 cent or 5 cents. More recently, a vending machine's product line has been broadened to include cookie/cracker type products in addition to the historical candy-type products. Also, and importantly, the price of such products has been increased over the years from 5 cents to 20 cents or even more per package. However, in developing the vending machine market it has become apparent that vending machines can be used to sell many different types of products in addition to the candy and cookie/cracker-type products. Hence, it has been found desirable to provide vending machines that are readily adaptable to the sale of products having substantially any price between, for example, 5 cents and $1.50.

A vending machine is basically made up of a credit system (which may include a coin rejector, a credit device, and a coin changer), an interlock device, and a product dispenser. To obtain a product from the vending machine, a consumer deposits a coin(s) in the vending machine's coin slot. The coin first proceeds through the coin rejector where it is accepted as a valid coin, or rejected as either a slug or of the wrong denomination. In vending machines of the type capable of dispensing products having a value greater than that of a single coin, for example, fifteen cents, once the coin has passed through the coin rejector it proceeds into the credit device where it may be totaled or added to those coins previously deposited. After the coin has been registered by the credit device, it proceeds into a coin box. If the coinage deposited is greater than that required, the coin changer provides change to the customer.

When the total coinage required (as registered by the credit device) has been deposited and change (if any) made, the product dispenser, that is, the apparatus for releasing the candy or other type product from the machine, can be completely actuated by the consumer to provide the consumer with the selected product. If the total coinage required has not been deposited in the vending machine, an interlock device functions to prevent the product dispenser from being completely actuated by the customer. The interlock device is interconnected between the credit system and the product dispenser and, in effect, establishes a lock on the product dispenser mechanism so that a product cannot be dispensed by a customer unless and until sufficient coinage has been deposited. The function of the interlock device, therefore, plays an extremely important part in the overall operation of the vending machine in that it establishes a lock which prevents the product dispenser from providing a product package to a customer before sufficient coinage has been desposited in the machine, and releases that lock so a package can be dispensed when sufficient coinage has been deposited.

There are two basic types of vending machines, one basic type being electrical, i.e., electrically controlled, and the other basic type being mechanical, i.e., mechanically controlled. In the electrical type, both the credit system and the product dispenser are basically operated through electrical and/or electromechanical means. In the mechanical type, both the credit system and the product dispenser are operated mechanically through mechanical linkage structures, so that no electric power input is required. Both electrical vending machines and mechanical vending machines have advantages and both, of course, have disadvantages. For example, in electrical vending machines where the coin changer and the product dispenser are both electrically controlled, the electrical controls for the product dispenser present a useful life reliability problem not always found in mechanical linkage type product dispensers. In other words, mechanical product dispensers are generally more reliable from useful life and lack of maintenance standpoints than electrical product dispensers. However, electrical credit devices are generally superior to mechanical credit devices in the sense that electrically controlled credit devices provide a far greater possible range of price scale, and greater operational reliability.

Hence, it has been one objective of this invention to provide a vending machine of the type that maintains the advantages of an electrically activated credit system and a mechanically activated product dispenser, the two being interconnected by an electromechanical interlock device.

It has been another objective of this invention to provide an electromechanical interlock device for a vending machine of the type having an electrical credit system and a mechanical product dispenser, that electromechanical interlock device including a solenoid electrically connected to the credit device and mechanically connected to the product dispenser.

It has been a further objective of this invention to provide an electromechanical interlock device for a vending machine of the type having an electrical credit system and a mechanical product dispenser, that electromechanical interlock device including a spring loaded latch lever that restrains an electric solenoid driven locking arm in an unlocked attitude relative to a mechanical drive cam after the credit device has registered coinage sufficient to vend a product, that locking arm being cammed by the drive cam out of the unlocked attitude as the product dispenser is manually operated to permit the locking arm to return into locking engagement with the drive cam after the product has been vended.

In accordance with the objectives of this invention, and in preferred form, the electromechanical interlock device of this invention includes a solenoid electrically connected to the credit system, and a drive cam adapted to be positively rotated by the manually operated mechanical product dispenser. The interlock device also includes a locking arm spring loaded into locking engagement with the drive cam to prevent unauthorized rotation thereof, an activator arm connected to the solenoid and adapted to remove the locking arm from locking engagement with the drive cam, and a latch lever. The solenoid is electrically energized upon deposit of the coinage required to achieve vending of a product, the solenoid driving the activator arm and, hence, the locking arm, into the unlock position, thereby withdrawing the locking arm from interlock engagement with the drive cam. As the locking arm's unlock position is achieved, the latch lever, which is tension spring connected with the locking arm, latches the activator arm in the unlock attitude, thereby also latching the lock arm in the unlock position. Subsequently, the drive cam is rotated by the manually operated mechanical product dispenser as that dispenser is operated by the customer to vend a product. The drive cam contacts the latch lever during the drive cam's rotational movement to remove the latch lever from latched engagement with the activator arm. Such permits the spring loaded locking arm to reset into locking relation with the drive cam once the product dispenser's vend cycle has been completed.

Other objectives and advantages of this invention will be more apparent from the following detailed description taken in conjunction with the drawings in which.

GENERAL STRUCTURE AND OPERATION

Figure 1:
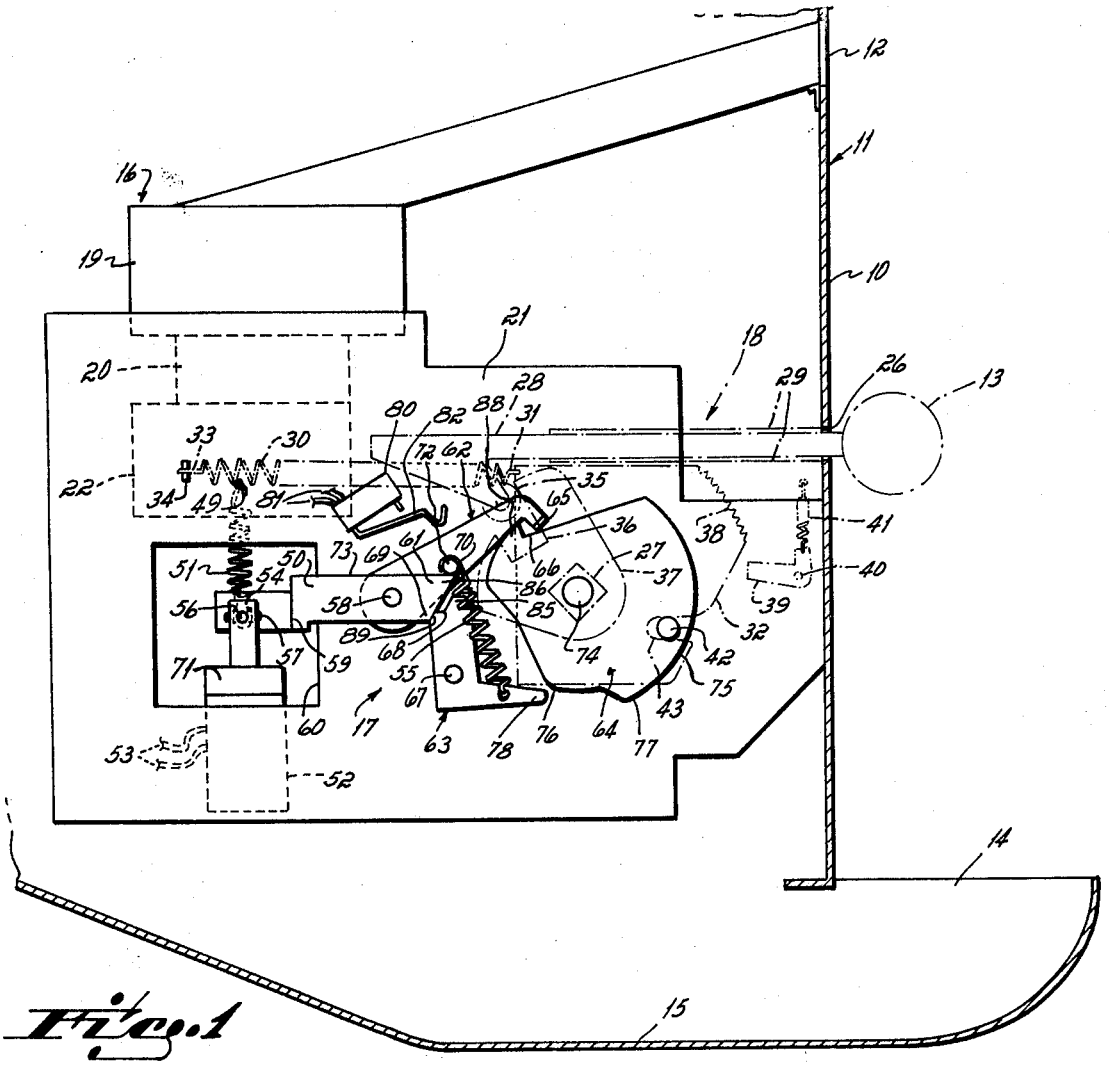
FIG. 1 is a side view of an electromechanical interlock device in accord with the principles of this invention, and of a mechanical product dispenser mechanism's drive mechanism associated therewith.

This invention is illustrated in a vending machine environment in FIG. 1 wherein there is shown a front face 10 for a vending machine housing 11 which presents, in vertical relation from top to bottom, a coin feed slot 12, a product dispenser handle 13 and an open access window or port 14 to enable the customer to retrieve the purchased product (not shown) from access tray 15. FIG. 1 also generally illustrates an electrical credit system 16 which cooperates with the coin feed 12 slot and product dispenser's drive mechanism 18. The credit system 16 includes a coin rejector 19 (not shown in any detail), an electrical credit accumulator device 20 (also not shown in any detail), and a coin changer 22, see FIG. 1. The coin rejector 19 functions to examine each coin deposited by a consumer in the vending machine's coin slot 12 to determine whether or not it is a valid coin or a slug. The electrical credit accumulator device 20 totals the coins deposited in the vending machine between product purchases and through coin changer 22 functions to make change for the customer if other than the exact coinage is deposited.

The electromechanical interlock device 17 of this invention interconnects the electrical credit system 16 and the mechanical product dispenser's drive mechanism 18, thereby preventing the product dispenser handle 13 from being pulled by a consumer to dispense a product until a total sum equal to the cost of a product is deposited. The electromechanical interlock device 17 components are all mounted on a common wall 21, thereby providing a modular structure that may be easily mounted in or demounted from suitable support structure (not shown) within the vending machine 11 to simplify initial installation of, and subsequent service on, the device.

In use, a coin feed chute directs a coin deposited in the coin feed slot 12 into the coin rejector 19. The coin, if it is an acceptable coin, passes through the rejector 19 to actuate the electrical credit accumulator device 20 where it is totaled. After passing through the credit accumulator device 20 the coin falls into its final resting place in a coin box (not shown) supported by the vending machine's housing 11. Once sufficient coinage is deposited, and after change (if any) has been provided by the coin changer 22, the electric credit system 16 activates, electrically, the electromechanical interlock device 17 to release the mechanical lock on the product dispenser's drive mechanism 18, thereby allowing the dispenser handle 13 to be manually pulled outwardly by the consumer to discharge a product from the machine's product storage magazine (not shown).

SPECIFIC STRUCTURE AND OPERATION

The coin rejector 19 utilized with the electromechanical interlock device 17 of this invention may be of any known structural configuration, such coin rejectors being commonly known to persons skilled in the art. Further, the credit accumulator device 20 and coin changer device 22 utilized with the electromechanical interlock device 17 of this invention may be of any known structural configuration, such devices also being commonly known to persons skilled in the art. Typical of such coin rejector, credit accumulator and coin changer structures are those illustrated in U.S. Pat. Nos. 3,197,009, 3,356,197, 3,249,193, and 3,159,260. The preferred electrical credit system 16 structure found useful in the environment of this invention is a Model 8–50–005 coin changer manufactured by National Rejectors Inc., 5100 San Francisco Avenue, St. Louis, Mo.

The manually operated product dispenser handle 13 is adapted to reciprocate through a hole 26 in the face 10 of the vending machine for dispensing a product package (not shown). The handle is part of a mechanical product dispenser (not completely shown) having a drive mechanism 18 which includes a main shaft 27 carried by the housing structure 11 in bearings (not shown). Rotation of the main shaft 27, by pulling out on the handle 13, sequentially actuates other parts of the manually operated mechanical dispenser mechanism to dispense a product package from that dispenser mechanism's supply magazine (not shown) to the machine's access window 14 where it may be picked up from tray 15 by a consumer. Such mechanical product dispensers are well known to those skilled in the art. A typical such dispenser is illustrated in U.S. Pat. No. 3,485,334.

The handle 13 is related to the main shaft 27 through a connector arm 28, the handle being spring loaded toward the home or inactive position by a return tension spring 30 fixed at one end 31 to a ratchet plate 32 and at the other end 33 to an ear 34 fixed to the machine's housing structure. The arm 28 is guided in reciprocatory path by upper and lower guide struts 29. Wheel 35 on tracking end of arm 28 is trapped in or engaged with throat 36 of drive plate 37, this drive plate being fixed to main shaft 27. Hence, drive plate 37 is rotated clockwise (as shown in FIG. 1) to rotate main shaft 27 (which, in turn, activates the rest of the product dispenser mechanism) as the arm 28 is horizontally pulled out through the face 10 of the vending machine.

Ratchet plate 32 is also fixed to the main shaft 27, and is provided with a ratchet edge 38 that cooperates with a pawl 39 pivotally connected, as at 40, to the housing structure. The pawl 39 is biased in a counterclockwise (as shown in the Figures) direction by spring 41. The ratchet plate 32 and pawl 39 cooperate to insure that the vending cycle of the product dispenser mechanism will be completed by the customer once that cycle is commenced by pulling on the handle 13. Rotation of the drive plate 37 through a clockwise arc, as illustrated in the Figures, and as induced by drawing handle 13 away from the machine's face 10, is translated to the electromechanical interlock device 17 through drive pin 42 which is part of the interlock device, that drive pin 42 being received in the ratchet plate's throat 43 when the interlock device is operatively engaged, i.e., in place, within the vending machine.

The electromechanical interlock device 17 of this invention interconnects the electrical credit system 16 with the mechanical product dispenser (more particularly, the product dispenser's mechanical drive mechanism 18) to prevent the product dispenser mechanism from being actuated by a customer until a total sum equal to the cost of a product is deposited, i.e., until the vend-credit position is achieved by the credit system. This electromechanical interlock device 17 includes an activator arm 50 operated by a tension spring 51 loaded solenoid 52. The tension spring 51 loaded solenoid 52 is fixed to the device's mounting plate 21, and is electrically connected through leads 53 to the electrical credit system's circuit (not shown). The electrical circuitry (not shown, but well known to those in the art) of the credit system 16 is such that when the electrical credit system reaches the vend-credit position, i.e., when sufficient coinage has been deposited to pay for a product, the solenoid 52 circuit is completed to activate or pulse the solenoid momentarily. Since the solenoid 52 is spring 51 loaded, and since the solenoid's circuit is normally open (i.e., since the solenoid is normally dead) the solenoid's armature 54 is normally spring 51 biased up into the home or rest position illustrated in FIG. 2 until vend-credit is achieved in the credit system 16. The armature 54 of the solenoid 52 is connected with the rear end of the activator arm 50 by pin 56 received in the arm's motion slot 57. The activator arm 50, which is pivotally carried on stud 58 fixed to one side of the mounting plate 21, is therefore adapted to pivot on that stud 58 as controlled by the solenoid 52. Tension spring 51 is fixed to the solenoid armature's pin 56 on one end and to the mounting plate at the other end 49. The solenoid 52 is fixed on the one side of the mounting plate 21, the activator arm 50 being stepped as at 59 to extend through port 60 in the plate, thereby permitting the leading or head end 61 of the activator arm 50 to cooperate with locking arm 62, latch lever 63, and drive cam 64 (as described in detail below) on the other side of the mounting plate 21.

The electromechanical interlock device 17 also includes the locking arm 62 which cooperates with drive cam 64 to lock the product dispenser until vend-credit has been achieved in the credit system 16, and to unlock the product dispenser once vend-credit has been achieved. The locking arm 62 is pivotally mounted at one end to baseplate 21 on the same stud 58 as the activator arm 50 is mounted, the locking arm and activator arm being pivotable relative one to the other on that stud. The locking arm 62 includes a thumb-type bolt 65 of right angular configuration at the nose or nonpivoted end thereof, that bolt being adapted to cooperate with, i.e., to seat in, lock notch 66 in the drive cam 64.

Figure 3:
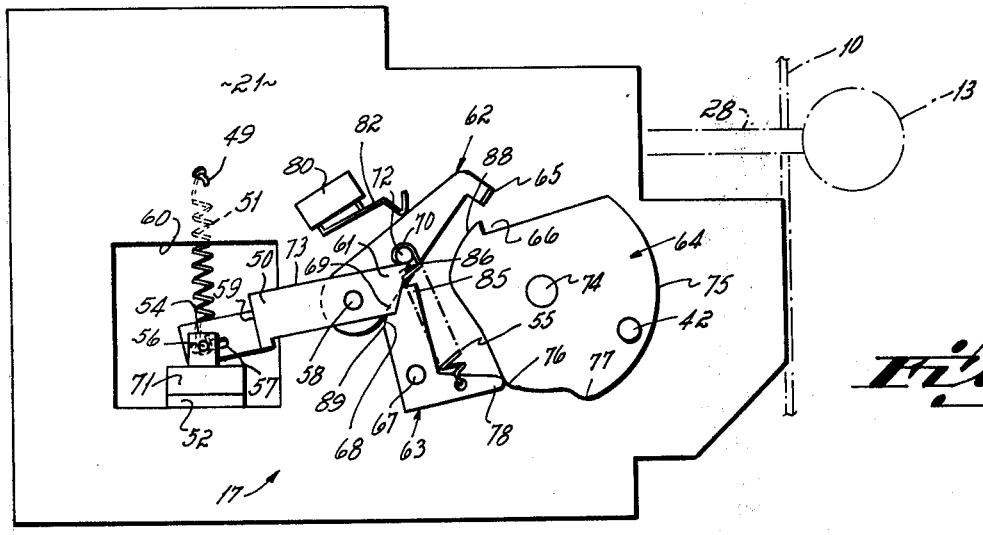
FIG. 3 is a side view similar to FIG. 2 illustrating the posture of the electromechanical interlock device immediately after sufficient coinage has been introduced into the electrical coin changer to permit vending of a product from the machine, but before operation of the mechanical product dispenser's drive mechanism is commenced.

Bellcrank-shaped latch lever 63 is pivotally connected to the mounting plate on stud 67. The latch lever 63 is, therefore, independently mounted relative to the locking arm 62 and the activator arm 50, and is pivotable relative to both the locking arm 50, and activator arm. One end of the bellcrank-shaped latch lever 63 is structured to define a seat 68 for a chin portion 69 of the activator arm's head end 61. The latch 63 and head end 61 of the activator arm 50 are essentially planar, and are located in the same vertical plane in the structural environment of the interlock device. Thus, the activator arm's head end 61 is sized and configured to locate in the seat 68 of the latch lever 63 when the activator arm and latch lever are oriented as is illustrated in FIG. 3.

Tension spring 55 is fixed at one end 70 to the locking arm and at the other end to the latch lever 63. That end 70 of the tension spring fixed to the locking arm 62 is so fixed on pin 72 (which pin 72 is permanently mounted to, and extends from, the locking arm). This pin 72 also extends through the vertical plane within which the activator arm's head end 61 and latch lever 63 are located, and is positioned on the locking arm so as to interengage the head end of the activator arm at certain times during operation of the device, compare FIGS. 1–5. The tension spring 55 continuously biases the locking arm 62 in a clockwise direction (as illustrated in the Figures), and the same tension spring 55 also continuously biases the latch lever 63 in the counterclockwise direction (as illustrated in the Figures), thereby continuously biasing the latch lever's seat 68 end (although not always the latch seat 68 itself) into contact with the activator arm's chin 69.

The locking arm 62/activator arm 50 structure, and the latch lever 63, are interrelated one with the other by the drive cam 64. The drive cam 64 is mounted to the base plate 21 on post 74, and is free to rotate relative to that post. Note that the drive cam 64 is coaxially disposed relative to the product dispenser's main shaft 27 when the interlock device 17 is in operational relation with the vending machine. The drive cam 64 provides a first cam surface in the form of a specially configured outer periphery 75 from point 76 to point 77 on that periphery that is adapted to cooperate with the latch lever's reset nose 78. The planar drive cam 64 and a second cam surface in the form of the latch lever's planar reset nose 78 are disposed in the vertical same plane. The cam periphery 76–77 of the drive cam 64 is particularly important in that same permits the reset operation of the activator arm 50 and of the locking arm 62 as the product dispenser's drive mechanism 18 is operated by a customer. Further, and as previously mentioned, the drive cam's outer periphery 75 also defines the lock notch 66 adapted to cooperate with the locking arm's bolt 65. Thus, lock notch 66 on the drive cam 64 cooperates with the locking arm's bolt 65 to establish an interlock on the product dispenser's drive mechanism 18 (and, hence, the entire product dispenser) unless and until sufficient coinage is deposited in the vending machine by the customer so as to satisfy, i.e., to achieve vend-credit within, the credit system 16. Drive pin 42 is carried by the drive cam 64 in fixed relation thereon, the drive pin 42 being received within throat 43 of the product dispenser drive mechanism's ratchet plate 32 when the electromechanical interlock device 17 of this invention is located in operating position within the vending machine and with the product dispenser's drive mechanism 18, thereby drivingly interconnecting the interlock device of this invention with the product dispenser's drive mechanism 18 (and, more particularly, with the product dispenser handle 13).

It is desirable in vending machines that the credit system be closed to the acceptance of further coins once the total price of the product selected by the customer has been deposited, i.e., once sufficient coinage has been deposited to achieve vend-credit. Such a function is generally accomplished by so-called coin block-out fingers (not shown) which, upon vend-credit attitude of the credit system 16, extend into the coin paths (not shown) within the system to deflect any further coins deposited by the customer out of the credit system and back out into a coin return slot (not shown) for return to the customer. In electrical credit systems, such coin block-out fingers may be electromagnetically operated. Such coin block-out finger devices are well known to the art, and form no part per se of the electromechanical interlock device 17 of this invention. However, some mechanism must be provided by means of which the electromagnetic coin block-out fingers are activated to perform the coin block-out function once vend-credit has been achieved within the credit system. In the electromechanical interlock device 17 of this invention, a switch 80 is fixed on the mounting plate 21 of the device, and is electrically connected through leads 81 with the circuit (not shown) that controls the electromagnetic coin block-out fingers (not shown). The switch 80 is maintained in the normally closed position so that the coin block-out fingers are normally retracted electromagnetically out of the coin paths as coins are deposited into the credit system 16. Note that switch 80 is placed on mounting plate 21 so that the switch's arm 82 is positioned to be contacted by the locking arm 62 of the interlock device. The position of the switch's arm 82 is such that the switch 80 is not activated prior to the credit system 16 achieving the vend-credit position (see FIG. 2), and such that the switch 80 is activated by lock arm 62 when the credit system is in the vend-credit position, compare FIGS. 2 and 3. When the switch 80 is so activated by the lock arm 62, the spring loaded electromagnetic fingers (not shown) are spring (not shown) biased into the coin guide paths (not shown) within the credit system 16, thereby causing any further coinage deposited to be deflected into the coin return slot (not shown).

Figure 2:
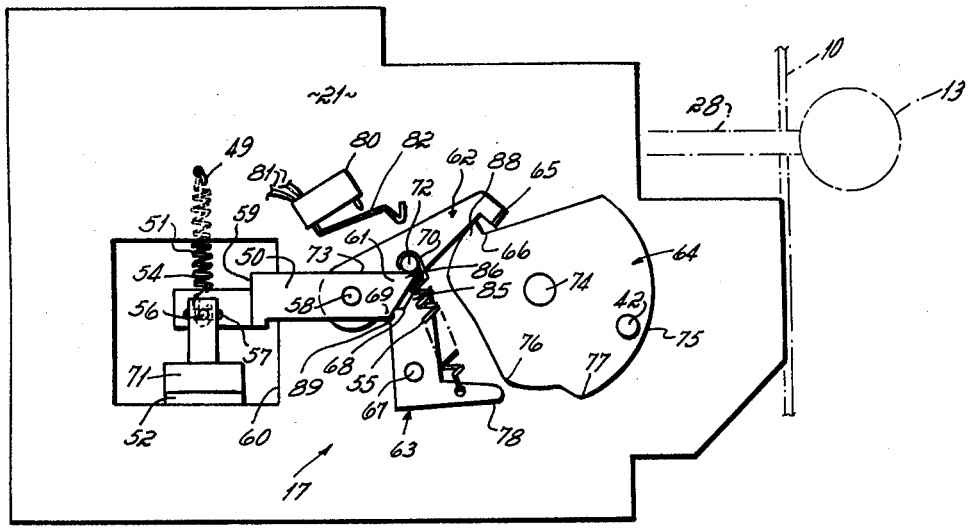
FIG. 2 is a side view of the electromechanical interlock device, the device being illustrated in the locking attitude at which no coinage or insufficient coinage has been presented to the electrical coin changer.

In operation of the electromechanical interlock 17 of this invention, the device is normally in the home or unactivated position illustrated in FIG. 2. In this home position, the credit system 16 is not in the vend-credit position, i.e., sufficient coinage has not yet been deposited by the customer to pay for the product selected from the vending position. Also in this home position, the activator arm 50 is maintained in the attitude illustrated by full extension of the solenoid's armature arm 54 as biased to that full extended position by tension spring 51. The home location of the activator arm 50 is achieved simply by the non-stressed or at-rest length of the tension spring 51 as shown in FIG. 2. In this home attitude locking arm 62 is biased clockwise and latch lever 62 is biased counterclockwise, i.e., arm 62 and lever 63 are biased toward one another, as so urged by tension spring 55. This, of course, causes the bolt end 65 of the locking arm 62 to overlie or set in the lock notch 66 in the drive cam 64, thereby preventing rotation of the drive cam, i.e., thereby preventing operation of the product dispenser's s drive mechanism 18. This for the reason, of course, that any attempt to pull the product dispenser handle 13 (and, thereby, rotate the drive plate 37/ratchet plate 32/drive cam 64 structure) meets with failure since clockwise rotation of the drive cam 64 is resisted by interengagement of the drive cam's lock notch 66 with the locking arm's bolt end 65.

As illustrated in FIG. 3, and as soon as the requisite coinage has been deposited as sensed by the credit system 16, i.e., as soon as the credit system achieves the vend-credit position, the solenoid 52 is electrically and momentarily activated or pulsed through leads 53 to draw momentarily the solenoid's arm 54 into the solenoid's housing, thereby causing the activator arm 50 to pivot counterclockwise as illustrated in the Figures. This counterclockwise pivot motion of the activator arm 50 causes the locking arm 62 to also pivot counterclockwise due to contact of the activator's head end 61 with the locking arm's pin 72, thereby pivoting the locking arm into the unlatched attitude illustrated in FIG. 3. The limit stop locating the activator arm 50 and locking arm 62 in the FIG. 3 attitude is established by a cushioned stop 71 around the solenoid's arm 54 which arm 50 contacts, thereby limiting inward motion of solenoid's arm 54 into the solenoid's housing. The FIG. 3 attitude, therefore, provides the unlock or product dispensing attitude of the interlock device 17 as the locking arm's bolt end 65 is removed from operational locking relationship with the drive cam's lock notch 66. Further, and importantly, as the activator arm 50 and locking arm 62 are pivoted into the unlatched FIG. 3 attitude by the momentary activation of solenoid 52, the latch lever 63 is also pivoted counterclockwise by tension spring 55 until its seat 68 engages the activator arm's chin 69, thereby preventing clockwise rotation of the activator arm once the momentary electrical impulse from the credit system 16 which activates the solenoid is released. The latch lever 63, therefore, latches the activator arm 50 in the latched open attitude and, thereby, also holds the locking arm 62 in the unlocked attitude, until the product dispenser is operated by the customer, i.e., until the product dispenser's handle 13 is pulled by the customer. This for the reason that the tension spring 55 restrains the latching arm's forehead 85 against leading edge 86 of the activator arm's head end 61, thereby insuring that the latch lever's seat 68 and the activator arm's chin 69 will remain interengaged in latched relationship until the latch lever 63 is positively moved in a clockwise direction as shown in the Figures. Of course, this latching relationship to restrain the locking arm 62 in the unlocked attitude is necessary because it may be some period of time between deposit of the final coin which achieves the vend-credit position in the credit system 16 and actual operation of the product dispenser's drive mechanism 18 by the customer.

Figure 4:
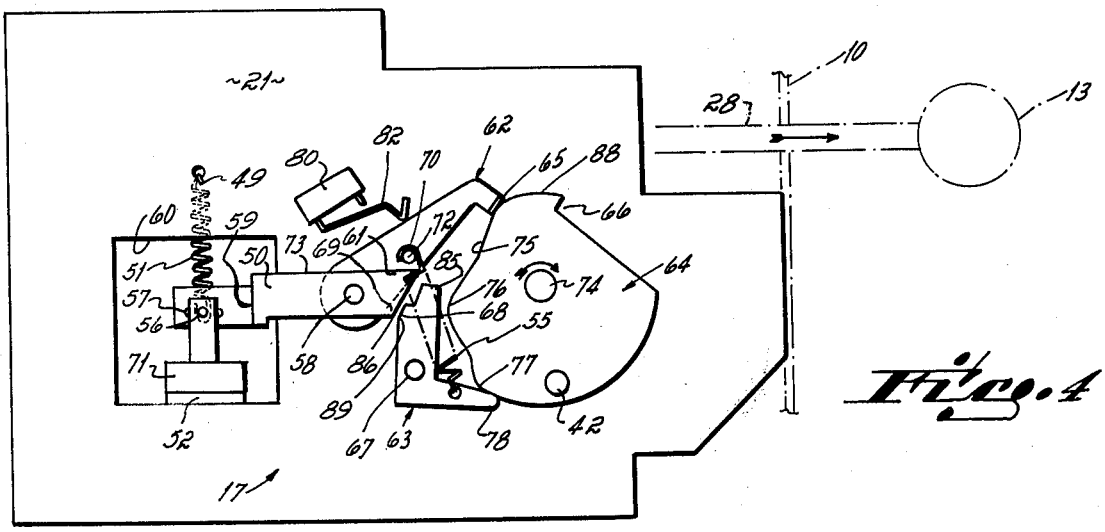
FIG. 4 is a side view similar to FIG. 3 showing the drive cam rotated to an intermediate position during manual operation of the mechanical product dispenser at an intermediate point in the product dispensing cycle.

The product dispenser's drive mechanism 18 may now be actuated by the customer. The product dispenser's handle 13, in its home position as illustrated in FIGS. 2 and 3, is initially drawn outwardly from the face 10 of the machine, i.e., from the home position, into an intermediate or vending attitude illustrated in FIG. 4. The motion of handle 13 from the home FIG. 2 position to the extended FIG. 3, i.e., the vend position, constitutes the vend stroke of the product dispenser's drive mechanism 18. In moving of the handle 13 into this vending position, the interlock device's drive cam 64 is rotated by interengagement of drive pin 42 with ratchet plate 32 (which is fixed to drive shaft 27). Because of the cam periphery 76–77 configuration, rotation of drive cam 64 causes contact of cam periphery 76–77 with the latch lever's foot 78, thereby depressing the latch lever in a clockwise direction against the bias of tension spring 55. Because the latch lever 63 is substantially bellcrank in configuration, the latching seat 68 is thereby removed from latch relationship with the chin 69 of the solenoid 52 driven activator arm 50. This, in turn, permits the tension spring 51 associated with the solenoid's arm 54 to move the solenoid arm 54 back into the fully extended position (analogous to the FIG. 2 position) until the activator arm's leading edge 86 abuts the latch lever edge 89 as shown in FIG. 4. Further, and in turn, rotation of the drive cam 64 causes the locking arm 62 to pivot in a clockwise direction under action of the tension spring 55, thereby bringing the locking arm's bolt end 65 into contact with the periphery 75 of the drive cam 64 at that location shown in FIG. 4.

Figure 5:
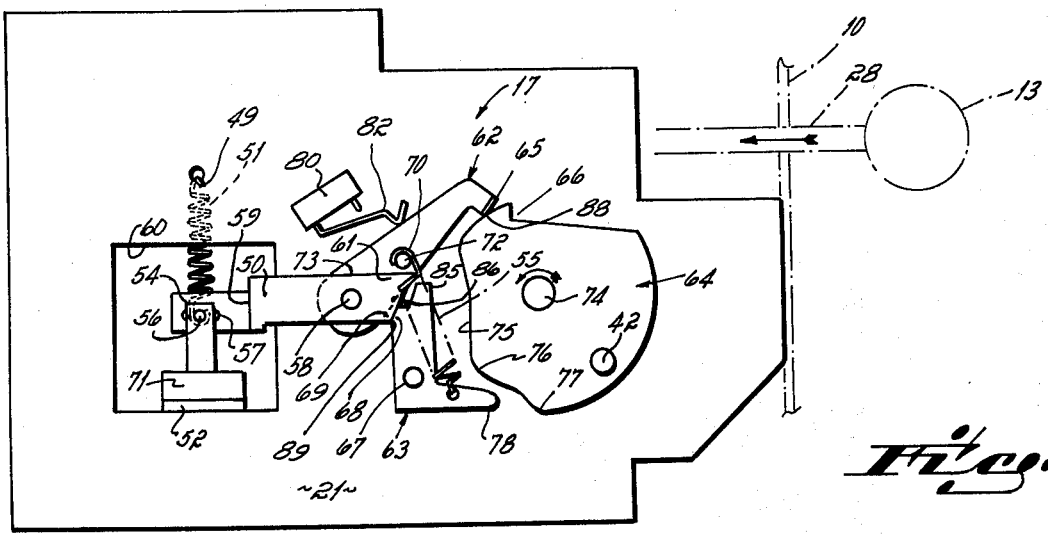
FIG. 5 is a side view similar to FIG. 4 illustrating return of the drive cam to the home position after a product has been dispensed from the product dispenser.

The return stroke or handle 13 release stroke of the product discharge cycle, i.e., of the product dispenser's drive mechanism 18, is provided by the return spring motor 30. Such return of the product dispenser handle 13 by the spring motor 30 also returns the drive cam 64 to the home or start position illustrated in FIG. 2. As the drive cam 64 returns from the vend or handle-out position (shown in FIG. 4) of the vend cycle through the return stroke or handle release stroke of the product discharge cycle, the resilience of the tension spring 55 permits the locking arm 62 to pivot counterclockwise relative to the latch lever 63 so that the locking arm's bolt end 65 can pass over the hump 88 in the drive cam 64 as it approaches the lock notch 66, thereby locating the locking arm's bolt 65 into locking relationship once again with the lock notch as illustrated in FIG. 2. During this return stroke of the handle 13, i.e., during the return counterclockwise motion (as illustrated in FIG. 5) of the drive cam 64, the latch lever 63 is retained in its home position relative to the activator arm 50 by virtue of edge 89, 86 contact of the latch lever 63 with the chin 69 of the activator arm's head 61. This latch lever edge 89/activator arm chin edge 86 contact retains the tension spring 55 in tension at the home position of the electromechanical interlock device 17 and, therefore, maintains the latch lever 63 ready at all times to pivot into latching relation with the activator arm 50 (as shown in FIG. 3) immediately in response to energization of the solenoid 52.

As noted earlier, the coin block-out switch 80 is electrically connected through leads 81 with coin block-out fingers (not shown) in the coin changer 22. The block-out fingers are electromagnetically operated (as is well known in the art), and are retained out of block-out relation until the electromechanical interlock device 17 is unlatched from the FIG. 2 into the FIG. 3 attitude as earlier explained. Once unlatching occurs, and once the FIG. 3 attitude of the interlock device 17 is achieved, the locking arm 62 activates the coin block-out fingers' switch 80 by pivoting arm 82, thereby opening the circuit with the coin block-out fingers in the coin changer device 22 so as to deflect any future coins deposited back to the customer. Further, and as soon as the interlock device 17 is returned from the FIG. 3 attitude into the FIG. 2 attitude, contact of the locking arm 62 with the switch arm 82 is denied, thereby deactivating the coin block-out fingers in the coin changer mechanism. Thus, the locking arm 62 performs two functions in the preferred structural environment in that it acts as the latch bolt to permit or deny operation of the product dispenser, and it controls switch 80 which determines the operational position of the coin block-out fingers (not shown) within the coin changer 22.

Having described in detail the preferred embodiment of my invention, what I desire to claim and protect by Letters Patent is:

1. An electromechanical interlock device adapted to interconnect an electric credit system with a mechanical product dispenser, said interlock device including a drive cam adapted to be moved from a home position to a vend position upon operation of said product dispenser, said drive cam having structure that defines a lock notch, a locking arm movable into and out of locking relation with said drive cam's lock notch, an electrically operated solenoid interconnected with said electric credit system, said solenoid and said locking arm being connected together in a manner that permits said locking arm to be moved out of locking engagement with said drive cam when said credit system achieves the vend credit position, and that permits said locking arm to be moved into locking engagement with said drive cam when said credit system is not in the vend credit position, and latch lever means associated with said locking arm, said latch lever means restraining said locking arm in an unlocked position after said locking arm is moved out of locking engagement with said drive cam by said solenoid, and said latching arm being so restrained until said product dispenser is activated by a customer.

2. An electromechanical interlock device as set forth in claim 1, said device including an activator arm operatively connecting said solenoid with said locking arm, said activator arm including a head against which said locking arm is spring loaded when in the home position and a chin adapted to seat within a latch seat defined in said latch lever means when in the active position.

3. An electromechanical interlock device as set forth in claim 1, said drive cam including means adapted to cooperate with said latch lever for removing said latch lever from latching interconnection with said locking arm upon activation of said product dispenser by a customer, thereby permitting said locking arm to move back into locking relation with said drive cam's lock notch.

4. An electromechanical interlock device as set forth in claim 1, said electric credit system including at least one coin block out finger, said device also including a switch having an arm positioned to permit contact with one of said drive cam, said locking arm and said latch lever means when said interlock device is in the unlocked position, said switch being electrically connected with said credit system to operate said coin block out fingers within said credit system when said interlock device is in the unlocked position.

5. An electromechanical interlock device as set forth in claim 3 wherein said latch lever removal means includes a first cam surface defined on said drive cam, and a second cam surface defined on said latch lever, said cam surfaces contacting one another to remove said latch lever from latching interconnection with said locking arm upon activation of said product dispenser by a customer.

6. An electromechanical interlock device as set forth in claim 5 including a tension spring interconnecting said latch lever and said locking arm, said tension spring continuously biasing said latch lever toward camming contact with said drive cam and continuously biasing said locking arm toward locking engagement with said drive cam.

* * * * *